US011183796B2

(12) United States Patent
Song et al.

(10) Patent No.: US 11,183,796 B2
(45) Date of Patent: Nov. 23, 2021

(54) FIRST TERMINAL ASSEMBLY, FIRST CONNECTOR AND CONNECTOR ASSEMBLY

(71) Applicant: Dongguan Luxshare Technologies Co., Ltd., Dongguan (CN)

(72) Inventors: Tao Song, Dongguan (CN); Kun Liu, Dongguan (CN)

(73) Assignee: Dongguan Luxshare Technologies Co., Ltd., Dongguan (CN)

( * ) Notice: Subject to any disclaimer, the term of this patent is extended or adjusted under 35 U.S.C. 154(b) by 0 days.

(21) Appl. No.: 16/912,028

(22) Filed: Jun. 25, 2020

(65) Prior Publication Data

US 2020/0412061 A1 Dec. 31, 2020

(30) Foreign Application Priority Data

Jun. 28, 2019 (CN) ..... 201910580349.X

(51) Int. Cl.

| | |
|---|---|
| ***H01R 4/66*** | (2006.01) |
| ***H01R 13/6471*** | (2011.01) |
| ***H01R 12/72*** | (2011.01) |
| ***H01R 13/405*** | (2006.01) |
| ***H01R 13/514*** | (2006.01) |
| ***H01R 13/6587*** | (2011.01) |

(52) U.S. Cl.

CPC ..... *H01R 13/6471* (2013.01); *H01R 12/72* (2013.01); *H01R 13/405* (2013.01); *H01R 13/514* (2013.01); *H01R 13/6587* (2013.01)

(58) Field of Classification Search

CPC .... H01R 12/72; H01R 12/721; H01R 13/405; H01R 13/514; H01R 13/6471; H01R 13/6587

USPC ..... 439/79, 108

See application file for complete search history.

(56) References Cited

U.S. PATENT DOCUMENTS

| | | | | |
|---|---|---|---|---|
| 3,587,029 A * | 6/1971 | Knowles | H01R 13/6471 439/607.34 |
| 9,893,445 B1 * | 2/2018 | Ju | H01R 12/721 |
| 2021/0135403 A1 * | 5/2021 | Yang | H01R 13/6473 |

FOREIGN PATENT DOCUMENTS

| | | |
|---|---|---|
| CN | 105612664 B | 2/2018 |
| CN | 208655958 U | 3/2019 |

* cited by examiner

*Primary Examiner* — Khiem M Nguyen

(74) *Attorney, Agent, or Firm* — Birch, Stewart, Kolasch & Birch, LLP

(57) ABSTRACT

A first terminal assembly includes a first terminal and a second terminal. The first terminal includes a first body portion and a first extension arm. The first extension arm includes a first contact portion to contact a second connector. The second terminal includes a second body portion and a second extension arm. The second extension arm includes a second contact portion to contact the second connector. The first contact portion and the second contact portion are arranged in a staggered manner in a left-to-right direction and a top-to-bottom direction perpendicular to a connector mating direction. As a result, a space between the first contact portion and the second contact portion is increased, thereby improving the quality of signal transmission. The present application also relates to a first terminal module, a first connector and a connector assembly with the above-mentioned first terminal assembly.

20 Claims, 15 Drawing Sheets

FIRST TERMINAL ASSEMBLY, FIRST CONNECTOR AND CONNECTOR ASSEMBLY

CROSS-REFERENCE TO RELATED APPLICATION

This patent application claims priority of a Chinese Patent Application No. 201910580349.X, filed on Jun. 28, 2019 and titled "First Terminal Assembly, First Terminal Module, First Connector and Connector Assembly", the entire content of which is incorporated herein by reference.

TECHNICAL FIELD

The present application relates to a first terminal assembly, a first connector and a connector assembly, which belongs to a technical field of high-speed connectors.

BACKGROUND

Existing high-speed connectors, such as backplane connectors, generally include a socket connector and a plug connector mated with each other. The socket connector and the plug connector are provided with socket terminals and plug terminals for mating with each other. The plug terminal is generally in the shape of a flat plate, and the socket terminal is generally in the shape of an elastic arm having a protrusion. However, due to the large number of terminals of high-speed connectors, how to arrange these terminals reasonably in order to reduce the complexity of terminal manufacturing and improve the quality of signal transmission is a technical problem needs to be solved.

SUMMARY

The present application discloses a first terminal assembly including a first terminal and a second terminal. The first terminal includes a first body portion, a first extension arm connected to one end of the first body portion, and a first tail portion connected to the other end of the first body portion. The first extension arm is provided with a first contact portion adapted to contact a second connector. The second terminal includes a second body portion, a second extension arm connected to one end of the second body portion, and a second tail portion connected to the other end of the second body portion. The second extension arm is provided with a second contact portion adapted to contact the second connector. The first contact portion and the second contact portion are arranged in a staggered manner along a left-to-right direction and a top-to-bottom direction which are both perpendicular to a connector mating direction. Besides, the present application also discloses a first terminal module, a first connector and a connector assembly with the above-mentioned first terminal assembly.

By making the first contact portion and the second contact portion be arranged in a staggered manner along the left-to-right direction and the top-to-bottom direction which are both perpendicular to the connector mating direction, the present application is capable of increasing a space between the first contact portion and the second contact portion, thereby improving the quality of signal transmission.

DETAILED DESCRIPTION

Figure 1:
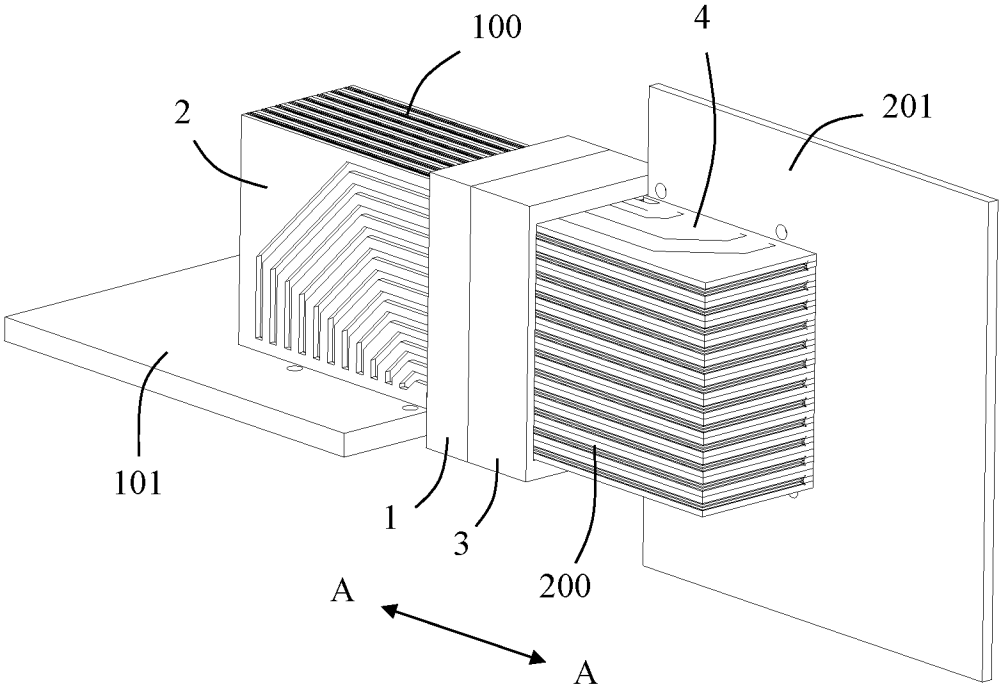
FIG. 1 is a schematic perspective view of a connector assembly according to an embodiment of the present application.
Figure 2:
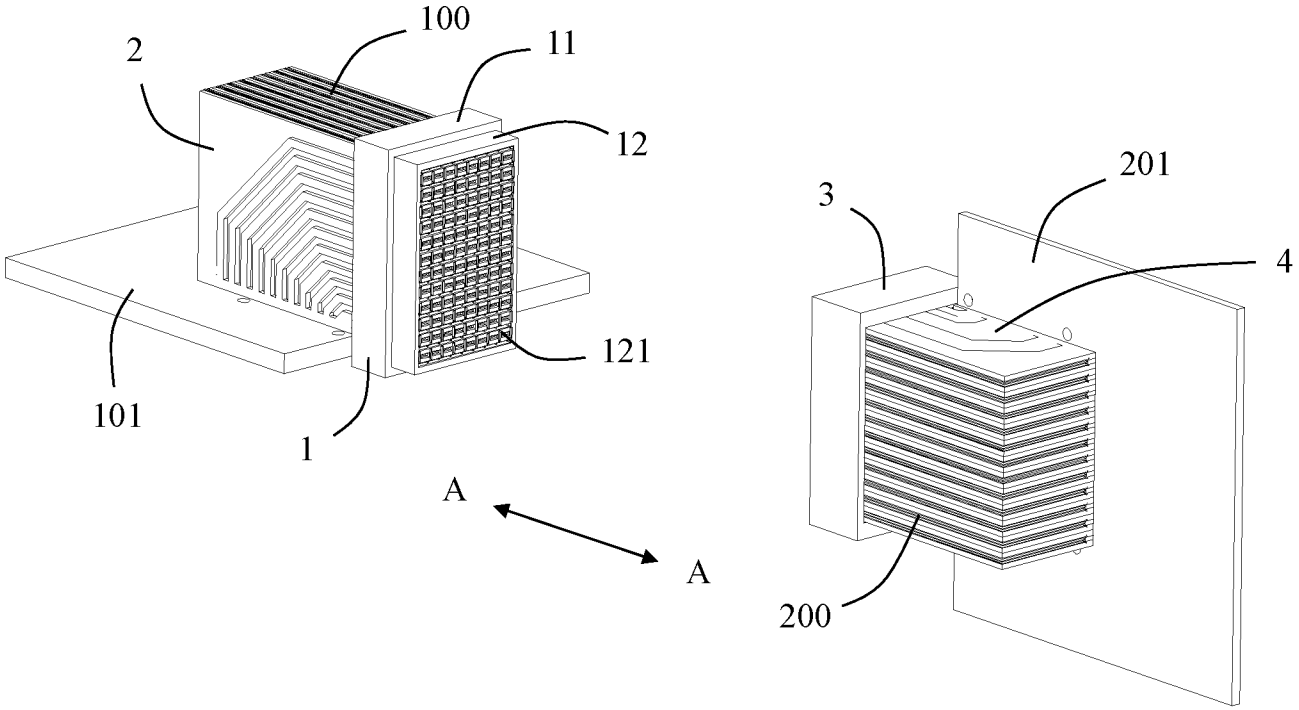
FIG. 2 is an exploded perspective view of FIG. 1.

Referring to FIG. 1 to FIG. 15, the present application discloses a connector assembly including a first connector 100 and a second connector 200 for mating with the first connector 100. In the illustrated embodiment of the present application, the first connector 100 is used to be mounted to a first circuit board 101, and the second connector 200 is used to be mounted to a second circuit board 201 which is perpendicular to the first circuit board 101. As shown in FIG. 2, the first connector 100 and the second connector 200 are mated along a connector mating direction A-A to achieve electrical communication between the first circuit board 101 and the second circuit board 201. It is understandable to those skilled in the art that, in other embodiments, the first connector 100 and/or the second connector 200 may also be used to connect with a cable, so as to achieve a cable-to-cable or a cable-to-circuit board electrical communication, of which detailed descriptions are omitted herein.

Figure 6:
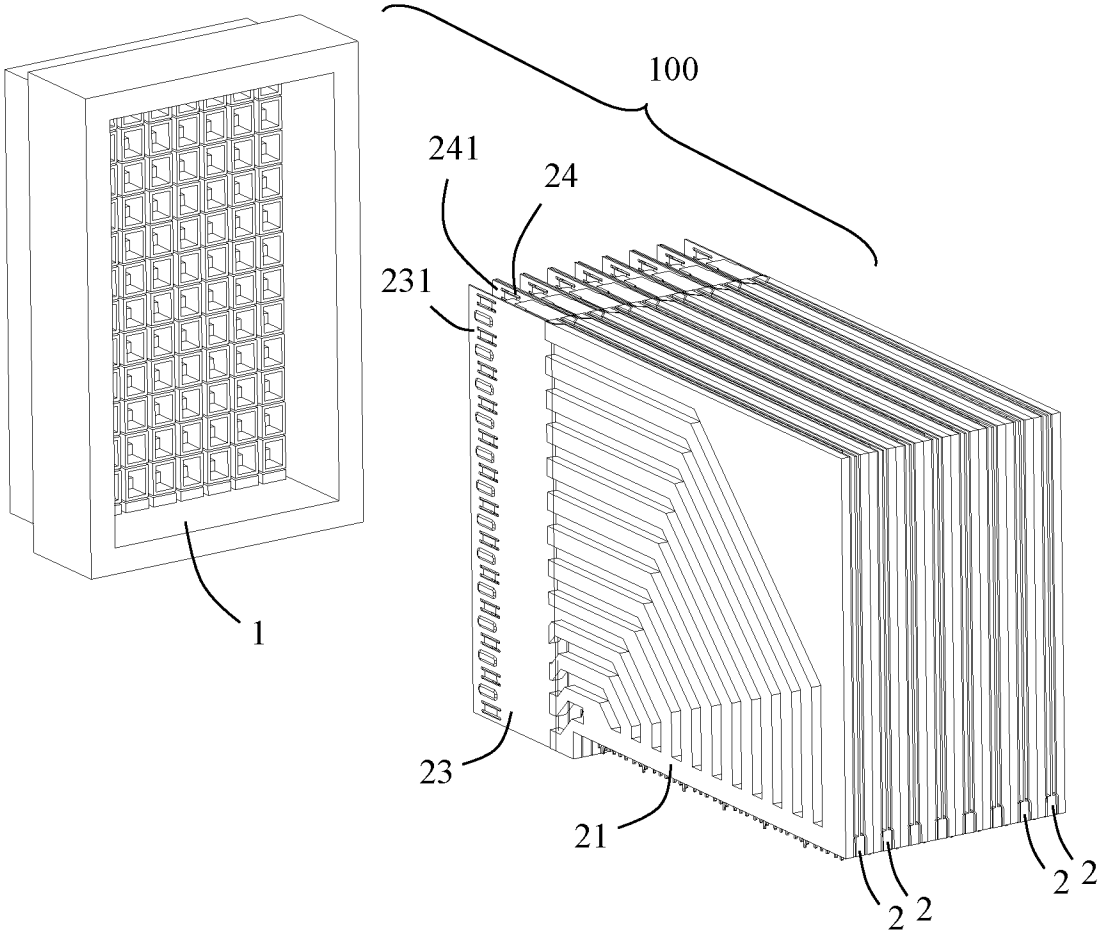
FIG. 6 is a partially exploded perspective view of the first connector of the present application.

Please refer to FIG. 2 and FIG. 6, the first connector 100 includes a first head housing 1 and a plurality of first terminal modules/wafers 2 arranged side by side and mounted to the first head housing 1. The first head housing 1 includes a first base portion 11 and a first mating portion 12 protruding from the first base portion 11. The first mating portion 12 is contracted compared to the first base portion 11. The first abutting portion 12 is provided with a plurality of first insertion holes 121 in a matrix shape.

Each first terminal module 2 includes a first insulating body 21, a first terminal assembly 22 fixed to the first insulating body 21, and a first grounding piece 23 and the second grounding piece 24 which are located on opposite sides of the first terminal assembly 22. In the illustrated embodiment of the present application, the first terminal assembly 22 is insert-molded with the first insulating body 21. The first grounding piece 23 and the second grounding piece 24 are also insert-molded with the first insulating body 21. The first terminal assembly 22 is positioned between the first grounding piece 23 and the second grounding piece 24. The first grounding piece 23 and the second grounding piece 24 can better shield the signal transmission, prevent cross-talk during the signal transmission and improve quality of the signal transmission.

Figure 15:
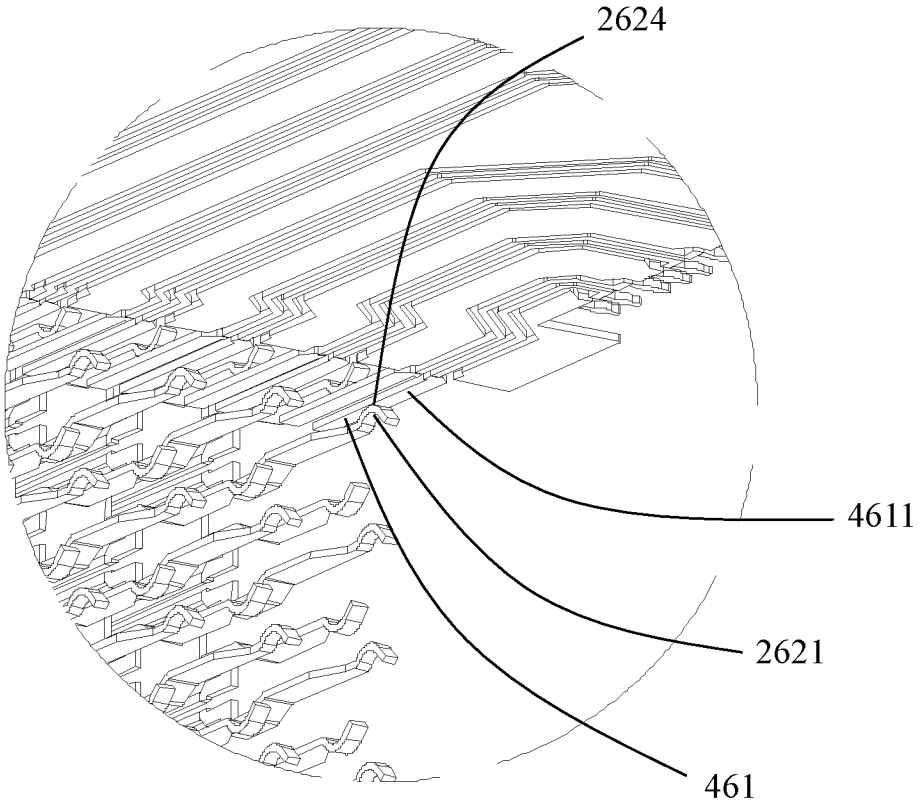
FIG. 15 is a partially enlarged view of a circled portion in FIG. 14.

The first terminal assembly 22 includes a first terminal 25, a second terminal 26 and a first ground terminal 27 located beside the first terminal 25 and the second terminal 26. The first terminal 25 includes a first body portion 251, a first extension arm 252 connected to one end (such as a front end) of the first body portion 251, and a first tail portion 253 connected to the other end (such as a bottom end) of the first body portion 251. The first extension arm 252 is provided with a first contact portion 2521 adapted to contact the second connector 200. The second terminal 26 includes a second body portion 261, a second extension arm 262 connected to one end (such as a front end) of the second body portion 261, and a second tail portion 263 connected to the other end (such as a bottom end) of the second body portion 261. The second extension arm 262 is provided with a second contact portion 2621 adapted to contact the second connector 200. In the illustrated embodiment of the present application, the first contact portion 2521 and the second contact portion 2621 are both elastic and a hook shape. The first extension arm 252 and the second extension arm 262 both extend forward beyond the first ground terminal 27. In the illustrated embodiment of the present application, the protruding direction of the first contact portion 2521 is opposite to that of the second contact portion 2621. That is, the first contact portion 2521 protrudes toward the second contact portion 2621, and the second contact portion 2621 protrudes toward the first contact portion 2521. Please refer to FIG. 13, the first contact portion 2521 is provided with a lower surface 2524 for contacting the second connector 200. As shown in FIG. 15, the second contact portion 2621 is provided with an upper surface 2624 for contacting the second connector 200. Please refer to FIGS. 5, 8 and 9, the first contact portion 2521 and the second contact portion 2621 are arranged in a staggered manner along a left-to-right direction and a top-to-bottom direction which are both perpendicular to the connector mating direction A-A. That is, the first contact portion 2521 and the second contact portion 2621 are not arranged in a row in the left-to-right direction and are not arranged in a row in the top-to-bottom direction. This arrangement increases the space between the first contact portion 2521 and the second contact portion 2621, thereby improving the quality of signal transmission.

Figure 9:
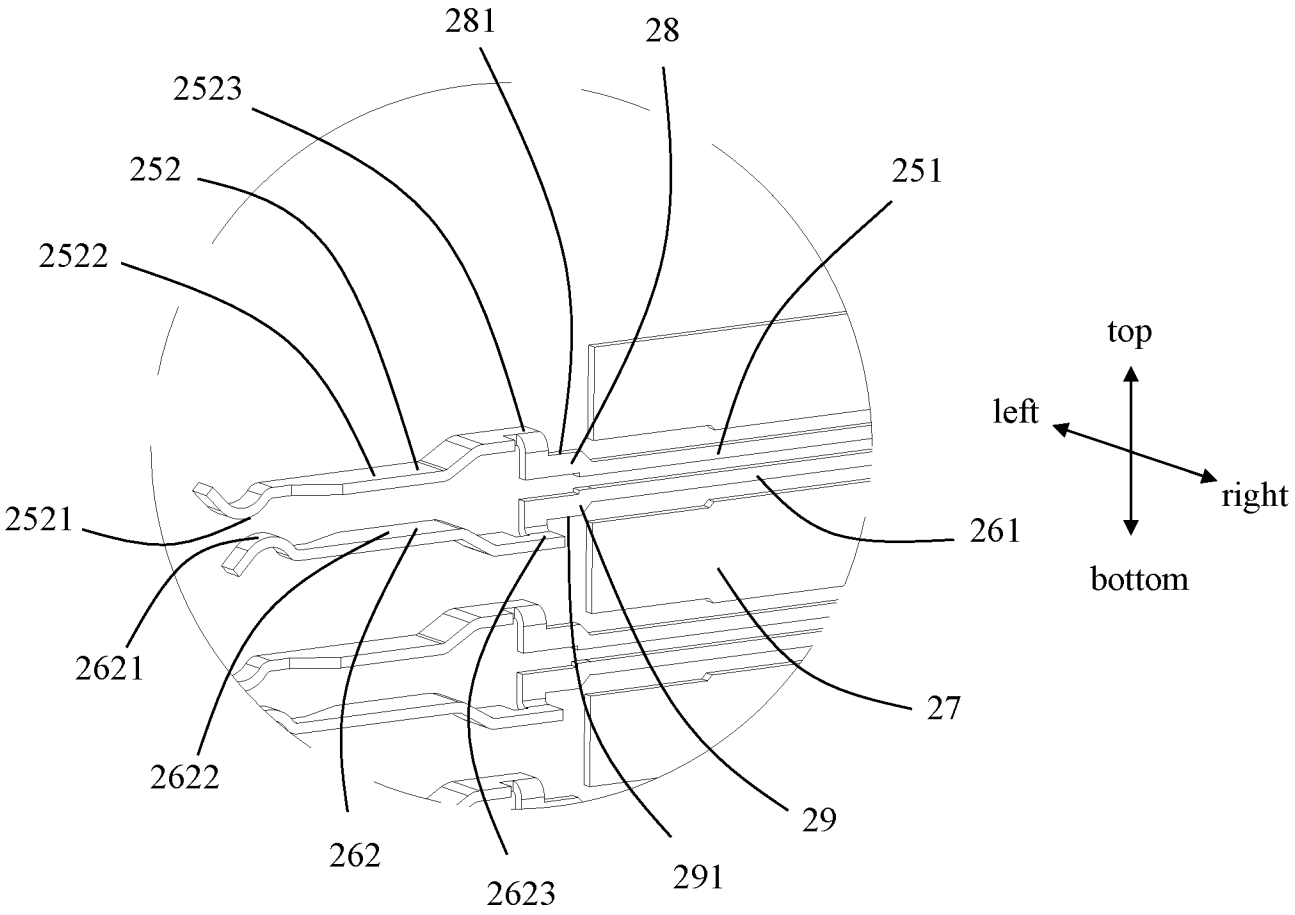
FIG. 9 is a partially enlarged view of a circled portion in FIG. 8.
Figure 10:
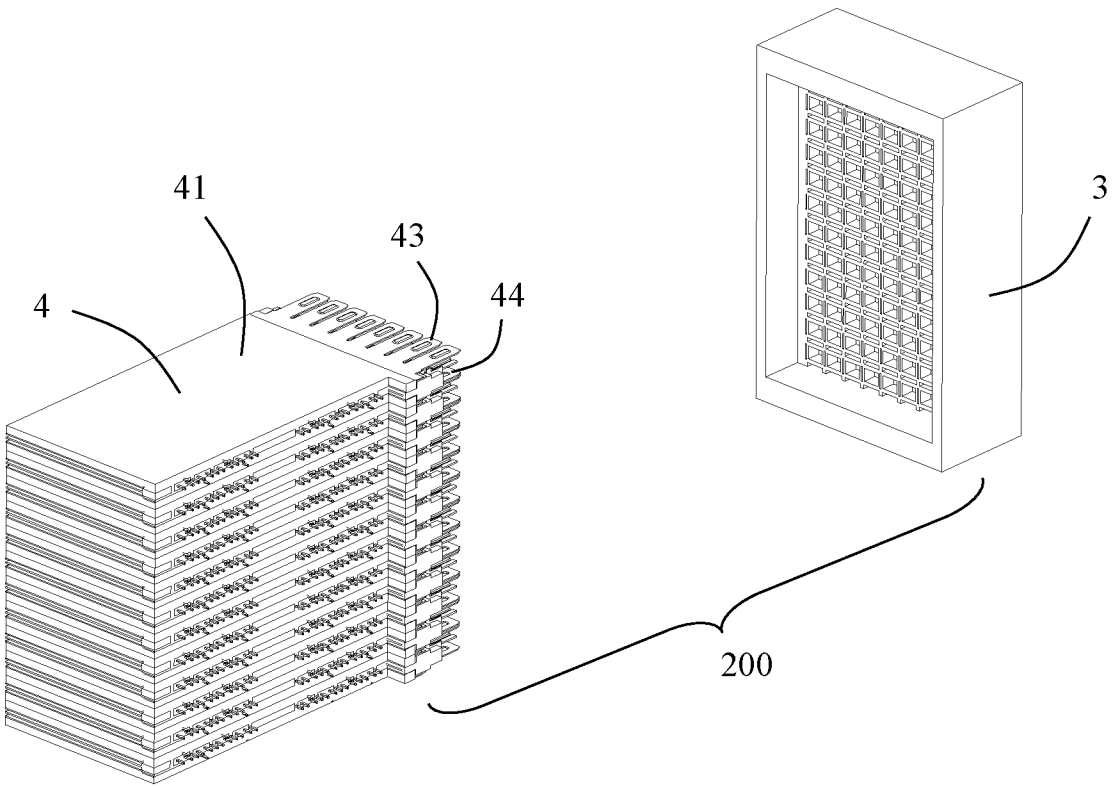
FIG. 10 is a partially exploded perspective view of a second connector according to an embodiment of the present application.

Specifically, as shown in FIG. 9, in the illustrated embodiment of the present application, the first terminal 25 includes a first base portion 28 having a first side edge 281. The first extension arm 252 is bent from the side edge 281 along a first direction (for example, a right-to-left direction). The second terminal 26 includes a second base portion 29 having a second side edge 291. The second extension arm 262 is bent from the second side edge 291 along a second direction (for example, a left-to-right direction). One of the first direction and the second direction is a left-to-right direction, and the first direction and the second direction are opposite. The first extension arm 252 is bent from the first side edge 281 along the first direction by 15 degrees to 165 degrees, and the second extension arm 262 is bent from the second side edge 291 along the second direction by 15 degrees to 165 degrees. In the illustrated embodiment of the present application, the first extension arm 252 is bent 90 degrees from the first side edge 281 along the first direction, and the second extension arm 262 is bent 90 degrees from the second side edge 291 along the second direction. Please refer to FIG. 9, in the illustrated embodiment of the present application, the first side edge 281 is located on an upper side of the first base portion 28, and the second side edge 291 is located on an lower side of the second base portion 29.

Compared to the existing technologies, the first extension arm 252 and the second extension arm 262 both extend parallel to the connector mating direction A-A. Neither the first extension arm 252 nor the second extension arm 262 has a twisting structure, which means both ends of the first extension arm 252 and the second extension arm 262 do not rotate relative to each other along their axes. As a result, the reliability of the terminals is improved, and the manufacturing difficulty of the terminals is reduced. In addition, through the first extension arm 252 and the second extension arm 262 with opposite bending directions, the first terminal assembly 22 can be mounted to the first circuit board 101 which is perpendicular to the second circuit board 201.

Specifically, as shown in FIG. 9, the first extension arm 252 includes a first widened portion 2522 extending backward from the first contact portion 2521 and a first bending portion 2523 bent backward from the first widened portion 2522. The first bending portion 2523 is connected to the first side edge 281 and is substantially perpendicular to the first base portion 28. The width of the first widened portion 2522 in the left-to-right direction is greater than the width of the first contact portion 2521 in the left-to-right direction. As a result, the first extension arm 252 is capable of having better structural strength. Generally, the first body portion 251 and the first base portion 28 are arranged vertically, that is, the height in the top-to-bottom direction is greater than the thickness in the left-to-right direction. In the meanwhile, the first extension arm 252 is arranged horizontally, that is, it the width in the left-to-right direction is greater than the thickness in the top-to-bottom direction. It can be understood that the first terminal 25 may be stamped and bent from a metal sheet. Before the first extension arm 252 is bent to the left, the first widened portion 2522 and the first bending portion 2523 are coplanar with the first body portion 251 and the first base portion 28. In this way, the first extension arm 252 is formed by punching the width of the metal sheet, and is bent to form the first contact portion 2521 which has a certain contact area or contact width. Even if the thickness of the metal sheet is not large, it does not affect the formation of the first contact portion 2521 with the certain contact area or contact width.

Similarly, as shown in FIG. 9, the second extension arm 262 includes a second widened portion 2622 extending backward from the second contact portion 2621 and a second bending portion 2623 extending backward from the widened portion 2622. The second bending portion 2623 is connected to the second side edge 291 and is substantially perpendicular to the second base portion 29. The width of the second widened portion 2622 in the left-to-right direction is greater than the width of the second contact portion 2621 in the left-to-right direction. As a result, the second extension arm 262 is capable of having better structural strength. Generally, the second body portion 261 and the second base portion 29 are arranged vertically, that is, the height in the top-to-bottom direction is greater than the thickness in the left-to-right direction. The second extension arm 262 is arranged horizontally, that is, the width in the left-to-right direction is greater than the thickness in the top-to-bottom direction. It can be understood that the second terminal 26 may also be stamped and bent from a metal sheet. Before the second extension arm 262 is bent to the right, the second widened portion 2622 and the second bending portion 2623 are coplanar with the second body portion 261 and the second base portion 29. In this way, the second extension arm 262 is formed by punching the width of the metal sheet, and is bent to form the second contact portion 2621 which has a certain contact area or contact width. Even if the thickness of the metal sheet is not large, it does not affect the formation of the second contact portion 2621 with the certain contact area or contact width. Please refer to FIG. 5, in the illustrated embodiment of the present application, the first widened portion 2522 and the second widened portion 2622 at least partially overlap along the top-to-bottom direction.

The first ground terminal 27 (G) includes a third body portion 271 and a third tail portion 273 connected to the third body portion 271. The first body portion 251, the second body portion 261, the third body portion 271, the first base portion 28 and the second base portion 29 are coplanar. The first tail portion 253, the second tail portion 263 and the third tail portion 273 are aligned along the connector mating direction A-A. In an embodiment of the present application, the first terminal 25 and the second terminal 26 form a differential pair, wherein one of the first terminal 25 and the second terminal 26 is a positive signal terminal (S+), and the other of the first terminal 25 and the second terminal 26 is a negative signal terminal (S−). In the illustrated embodiment of the present application, the first tail portion 253, the second tail portion 263 and the third tail portion 273 are all adapted to be electrically connected to the first circuit board 101.

Figure 7:
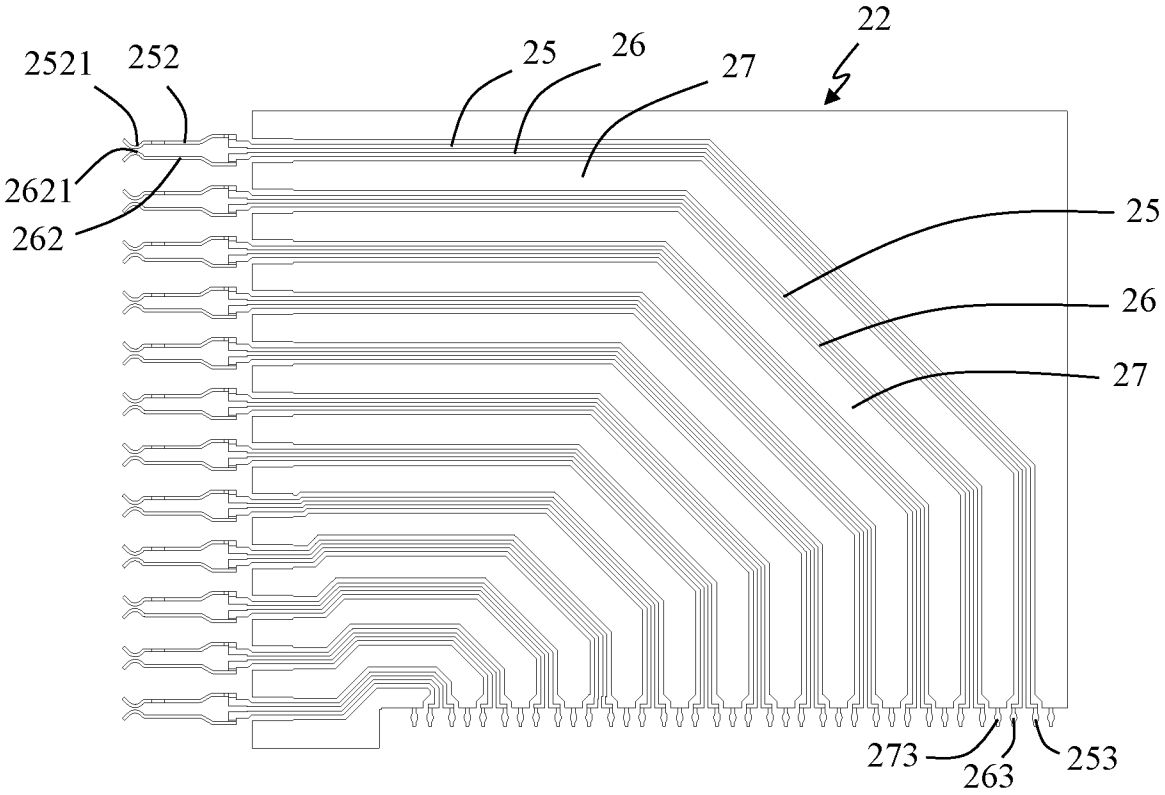
FIG. 7 is a side view of the first terminal assembly in FIG. 6.
Figure 8:
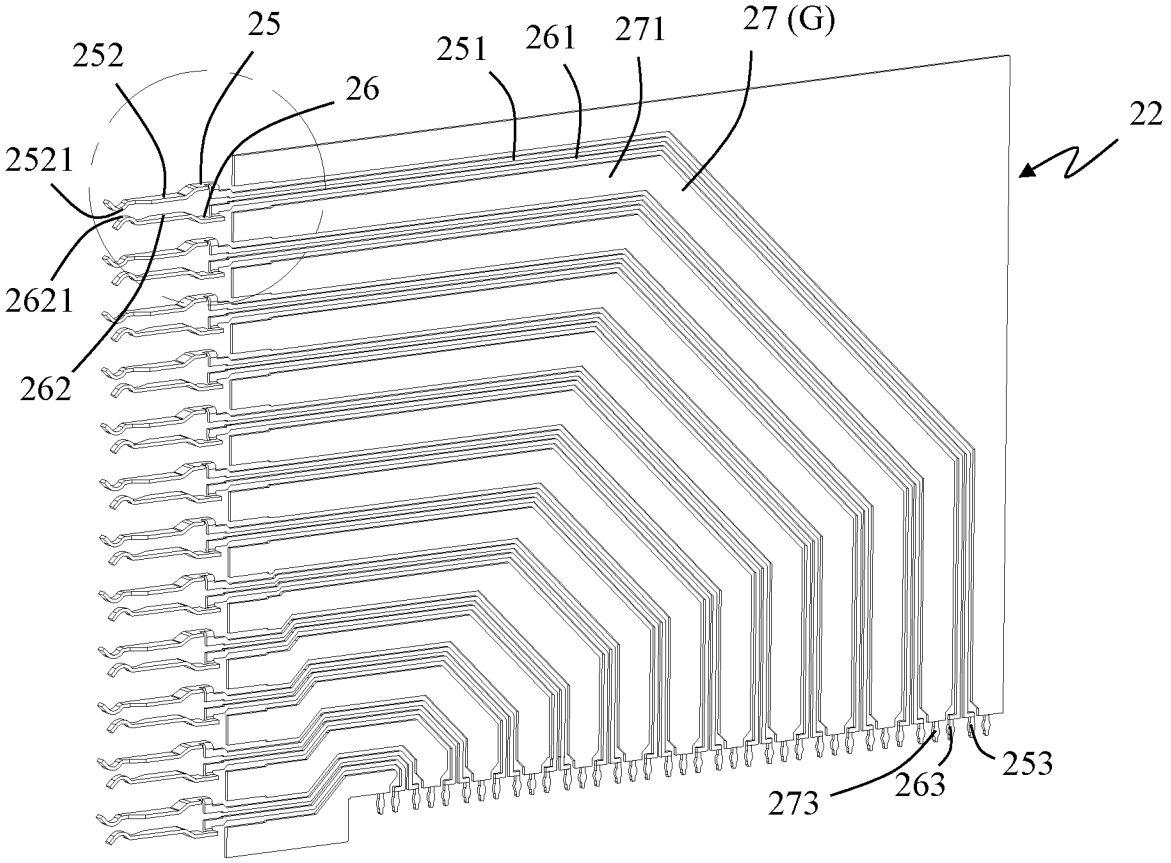
FIG. 8 is a schematic perspective view of a first terminal assembly.

Please refer to FIG. 7, in the illustrated embodiment of the present application, the distance between the first tail portion 253 and the second tail portion 263 is greater than the distance between the corresponding first body portion 251 and the second body portion 261. The distance between the first tail portion 253 and the second tail portion 263 along a front-to-back direction can be adjusted in a way which is good for improving the quality of signal transmission.

As shown in FIG. 7, in the illustrated embodiment of the present application, the first terminal assembly 22 includes a plurality of groups of the first terminal 25, the second terminal 26 and the first ground terminal 27.

As shown in FIG. 6, the first grounding piece 23 is provided with a first shielding portion 231 on one side of the first contact portion 2521 and the second contact portion 2621, and the second grounding piece 24 is provided with a second shielding portion 241 on the other side of the first contact portion 2521 and the second contact portion 2621. Preferably, the first grounding piece 23 and the second grounding piece 24 are symmetrically disposed on opposite sides of the first terminal assembly 22.

Figure 3:
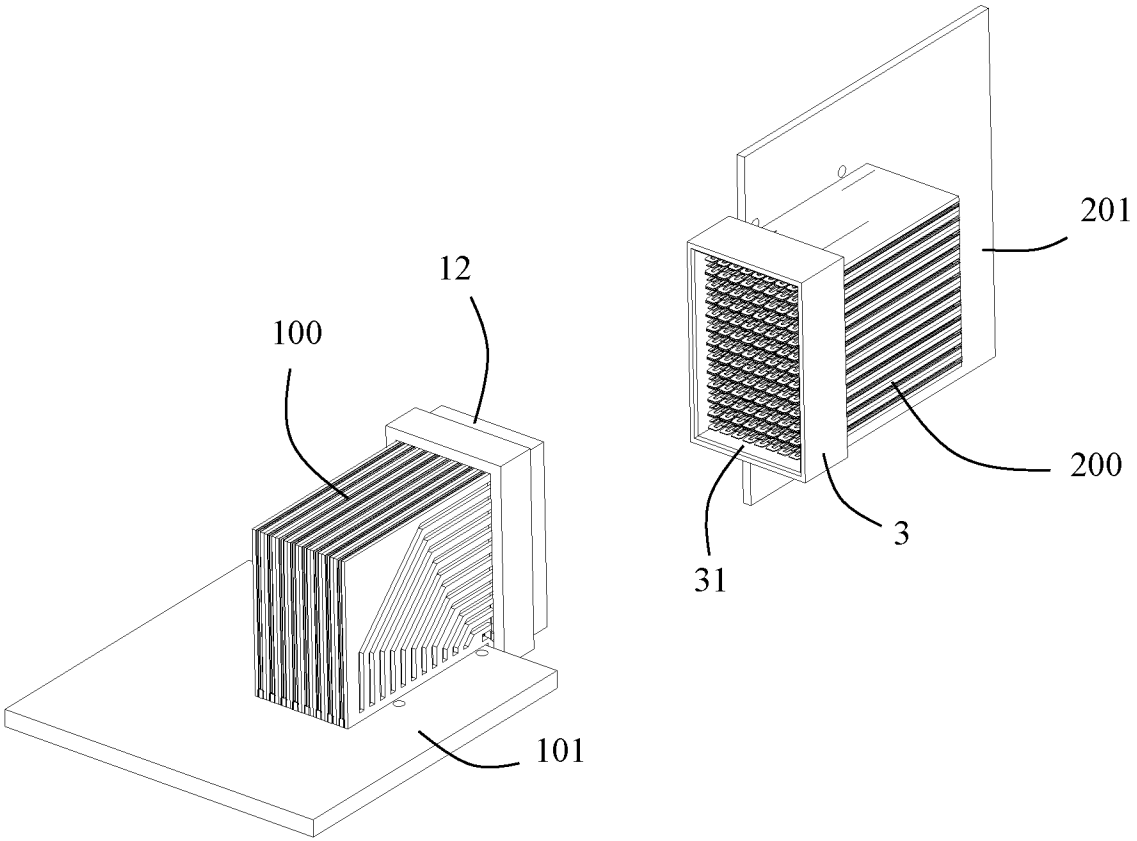
FIG. 3 is another schematic perspective view of FIG. 2.
Figure 4:
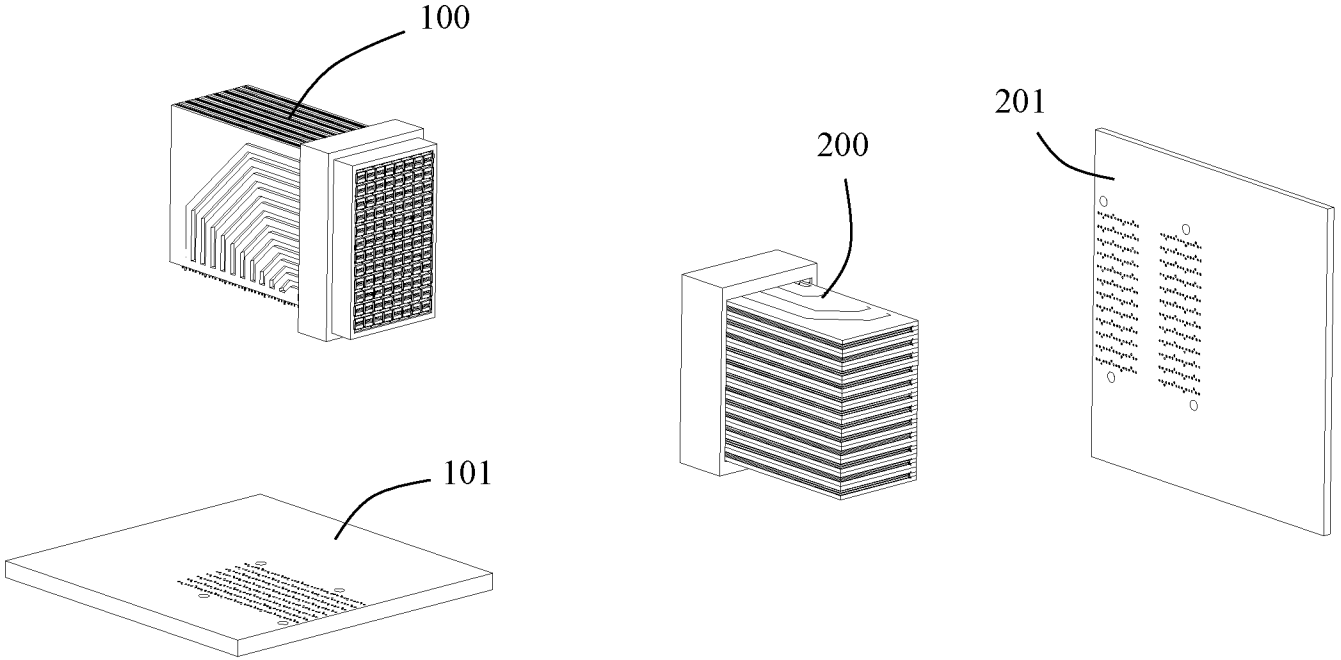
FIG. 4 is a further exploded perspective view of FIG. 3.
Figure 5:
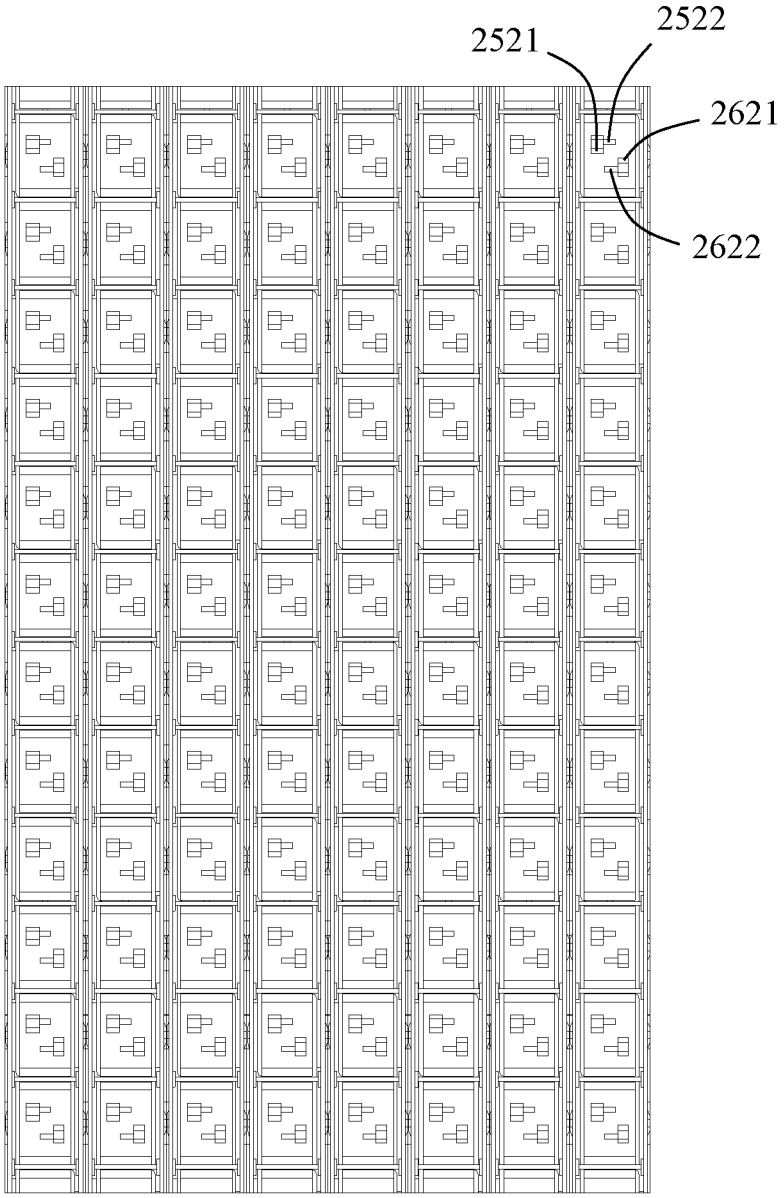
FIG. 5 is a front view of the first connector of the present application with the first head housing removed.

As shown in FIG. 3, the second connector 200 includes a second head housing 3 and a plurality of second terminal modules/wafers 4 arranged side by side and mounted to the second head housing 3. The second head housing 3 is provided with a receiving space 31 for receiving the first mating portion 12.

Each of the second terminal modules 4 includes a second insulating body 41, a second terminal assembly 42 fixed to the second insulating body 41, and a third grounding piece 43 and a fourth grounding piece 44 located on opposite sides of the second terminal assembly 42, respectively. In the illustrated embodiment of the present application, the second terminal assembly 42 is insert-molded with the second insulating body 41. The third grounding piece 43 and the fourth grounding piece 44 are also insert-molded with the second insulating body 41. The second terminal assembly 42 is positioned between the third grounding piece 43 and the fourth grounding piece 44. The third grounding piece 43 and the fourth grounding piece 44 can better shield the signal transmission, prevent cross-talk during the signal transmission and improve quality of the signal transmission.

Figure 11:
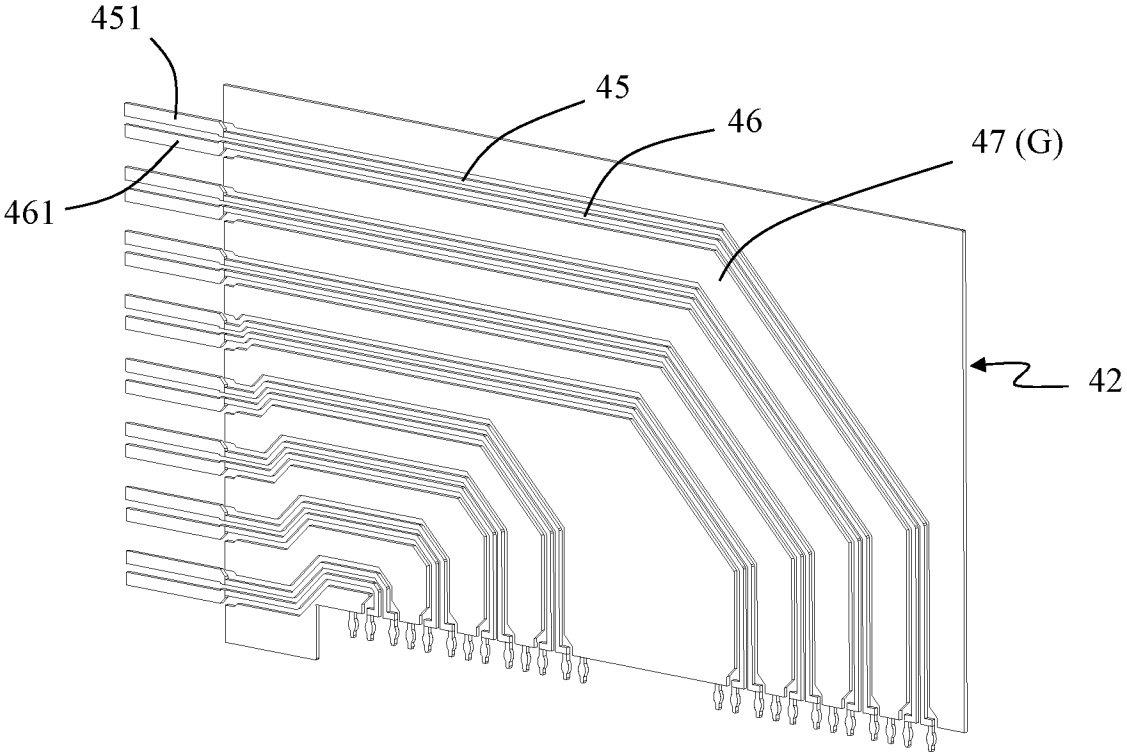
FIG. 11 is a schematic perspective view of a second terminal assembly.
Figure 12:
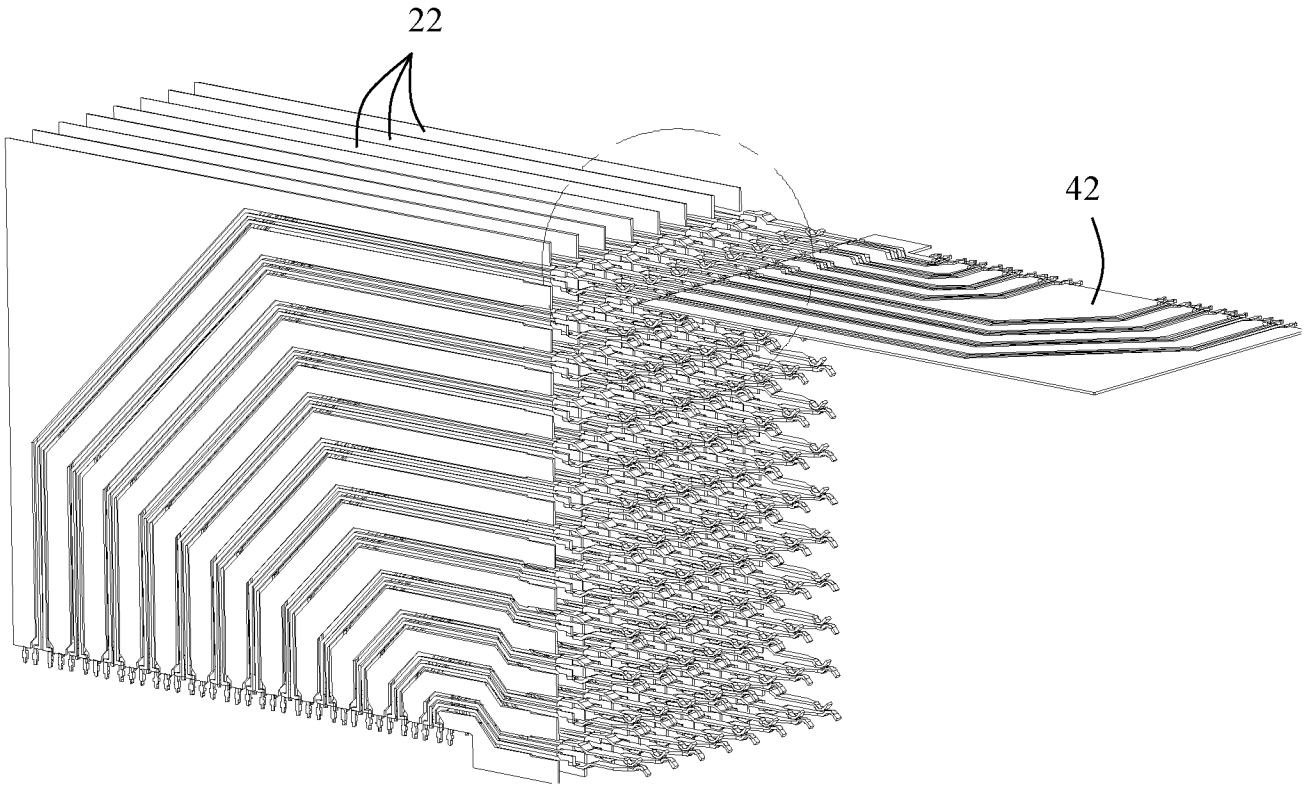
FIG. 12 is a perspective schematic view when a plurality of first terminal assemblies are matched with a piece of second terminal assembly.
Figure 13:
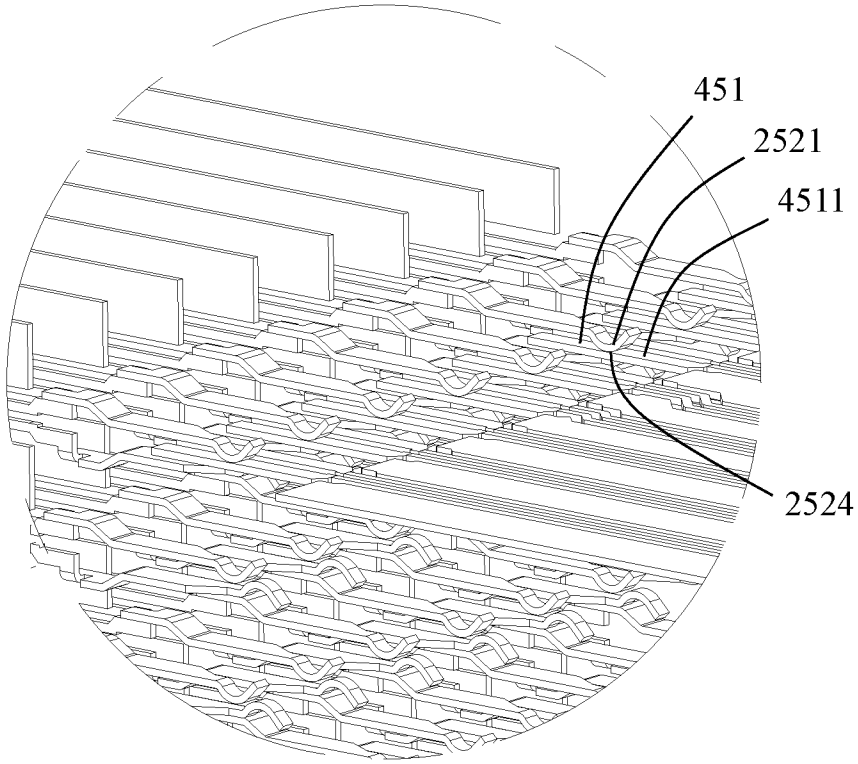
FIG. 13 is a partially enlarged view of a circled portion in FIG. 12.
Figure 14:
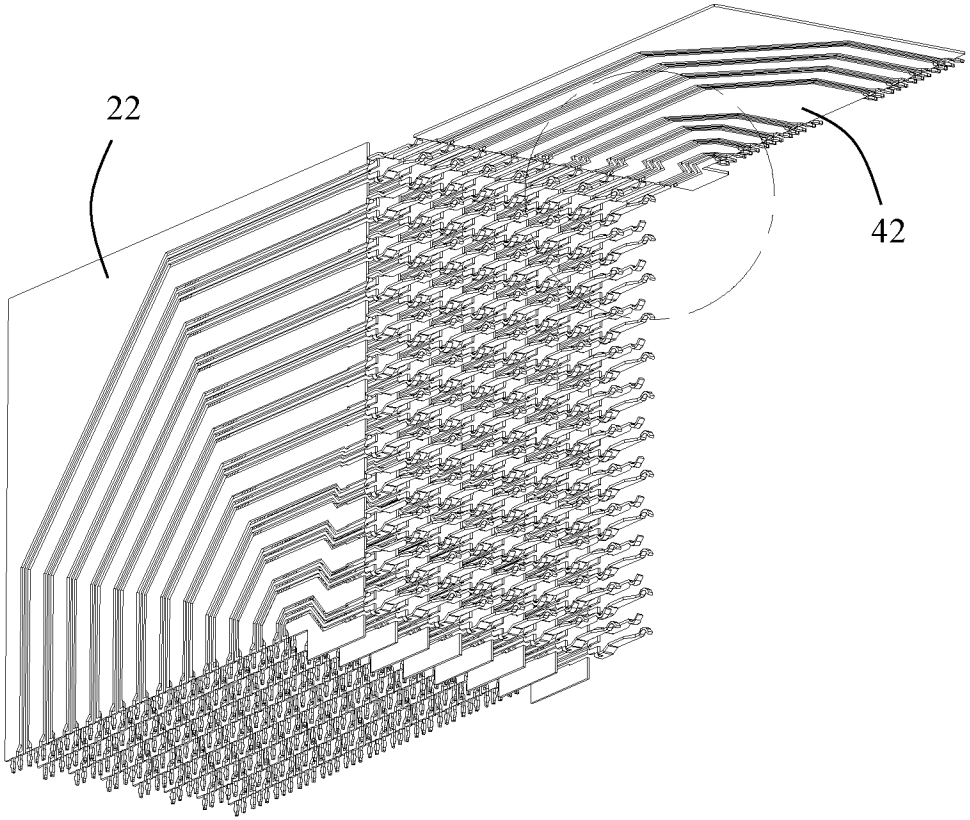
FIG. 14 is another schematic perspective view of FIG. 12.

As shown in FIG. 11, the second terminal assembly 42 includes a third terminal 45, a fourth terminal 46, and a second ground terminal 47 located beside the third terminal 45 and the fourth terminal 46. The third terminal 45 includes a third contact portion 451 for contacting the first contact portion 2521, and the fourth terminal 46 includes a fourth contact portion 461 for contacting the second contact portion 2621. The third terminal 45 and the fourth terminal 46 form a differential pair. In the illustrated embodiment of the present application, the third contact portion 451 and the fourth contact portion 461 protrude toward the first extension arm 252 and the second extension arm 262 and are of a flat plate shape, which are adapted to be inserted into the first insertion holes 121 of the first connector 100. Please refer to FIGS. 12 to 15, the third contact portion 451 includes an upper surface 4511 for contacting the first contact portion 2521, and the fourth contact portion 461 includes a lower surface 4611 for contacting the second contact portion 2621. The upper surface 4511 and the lower surface 4611 are two surfaces disposed in parallel. In the illustrated embodiment of the present application, the third terminals 45 and the fourth terminals 46 on the same second terminal module 4 are adapted to mate with the first terminals 25 and the second terminals 26 located at the same height, but on different first terminal assemblies 22 of the first connector 100. By mating the first terminal assembly 22 with the first extension arm 252 and the second terminal assembly 42 with the second extension arm 262 which is bent along an opposite direction of the first extension arm 252, it is capable of realizing interconnection of the first connector 100 and the second connector 200 through the first circuit board 101 and second circuit board 102 perpendicular to each other, which simplifies the overall structure of a connector assembly.

The above embodiments are only used to illustrate the present application and not to limit the technical solutions described in the present application. The understanding of this specification should be based on those skilled in the art. Descriptions of directions, such as "front", "back", "left", "right", "top" and "bottom", although they have been described in detail in the above-mentioned embodiments of the present application, those skilled in the art should understand that modifications or equivalent substitutions can still be made to the application, and all technical solutions and improvements that do not depart from the spirit and scope of the application should be covered by the claims of the application.

What is claimed is:

1. A first terminal assembly comprising:

a first terminal comprising:

a first body portion;

a first extension arm connected to one end of the first body portion, the first extension arm being provided with a first contact portion adapted to contact a second connector; and a first tail portion connected to the other end of the first body portion; and a second terminal comprising:

a second body portion;

a second extension arm connected to one end of the second body portion, the second extension arm being provided with a second contact portion adapted to contact the second connector; and a second tail portion connected to the other end of the second body portion, wherein the first contact portion and the second contact portion are arranged in a staggered manner along a left-to-right direction and a top-to-bottom direction which are both perpendicular to a connector mating direction.

2. The first terminal assembly according to claim 1, wherein the first terminal comprises a first base having a first side edge from which the first extension arm is bent along a first direction; and the second terminal comprises a second base portion having a second side edge from which the second extension arm is bent along a second direction, one of the first direction and the second direction is one of the left direction and right direction, and the first direction is opposite to the second direction.

3. The first terminal assembly according to claim 2, wherein the first base portion, the second base portion, the first body portion and the second body portion are coplanar; the first side edge is located on an upper side of the first base portion, and the second side edge is located on a lower side of the second base portion.

4. The first terminal assembly according to claim 2, wherein the first extension arm is bent from the first side edge along the first direction by 15 degrees to 165 degrees, and the second extension arm is bent from the second side edge along the second direction by 15 degrees to 165 degrees.

5. The first terminal assembly according to claim 1, wherein the first extension arm and the second extension arm both extend parallel to the connector mating direction; the first contact portion is provided with a lower surface adapted to contact the second connector, and the second contact portion is provided with an upper surface adapted to contact the second connector.

6. The first terminal assembly according to claim 1, wherein the first terminal and the second terminal form a differential pair in which one of the first terminal and the second terminals is a positive signal terminal, and the other of the first terminal and the second terminals is a negative signal terminal.

7. The first terminal assembly according to claim 6, wherein the first terminal assembly further comprises a first ground terminal located on side of the first terminal and the second terminal, and wherein the first ground terminal comprises a third body portion and a third tail portion connected to the third body portion, and wherein the first body portion, the second body portion and the third body portion are coplanar, and the first tail portion, the second tail portion and the third tail portion are aligned along the connector mating direction.

8. The first terminal assembly according to claim 1, wherein the first contact portion is a hook shape, and the second contact portion is a hook shape.

9. A first connector comprising:

a first head housing; and a plurality of first terminal modules arranged side by side and mounted to the first head housing; each first terminal module comprising:

a first insulating body; and a first terminal assembly comprising:

a first terminal insert-molded with the first insulating body and comprising:

a first body portion;

a first extension arm connected to one end of the first body portion, the first extension arm being provided with a first contact portion adapted to contact a second connector; and a first tail portion connected to the other end of the first body portion; and a second terminal insert-molded with the first insulating body and comprising:

a second body portion;

a second extension arm connected to one end of the second body portion, the second extension arm being provided with a second contact portion adapted to contact the second connector; and a second tail portion connected to the other end of the second body portion, wherein the first contact portion and the second contact portion are arranged in a staggered manner along a left-to-right direction and a top-to-bottom direction which are both perpendicular to a connector mating direction;

the first insulating body comprising:

a first grounding piece provided with a first shielding portion which is located on one side of the first contact portion and the second contact portion; and a second grounding piece provided with a second shielding portion which is located on the other side of the first contact portion and the second contact portion; wherein the first grounding piece and the second grounding piece are located on opposite sides of the first terminal and the second terminal.

10. The first connector according to claim 9, wherein the first terminal and the second terminal are both insert-molded with the first insulating body; the first terminal module further comprises a first grounding piece and a second grounding piece which are located on opposite sides of the first terminal and the second terminal, the first grounding piece is provided with a first shielding portion on one side of the first contact portion and the second contact portion; and the second grounding piece is provided with a second shielding portion on the other side of the first contact portion and the second contact portion.

11. The first connector according to claim 9, wherein the first terminal comprises a first base having a first side edge from which the first extension arm is bent along a first direction; and the second terminal comprises a second base portion having a second side edge from which the second extension arm is bent along a second direction, one of the first direction and the second direction is the left-to-right direction, and the first direction is opposite to the second direction.

12. The first connector according to claim 11, wherein the first base portion, the second base portion, the first body portion and the second body portion are coplanar; the first side edge is located on an upper side of the first base portion, and the second side edge is located on an lower side of the second base portion.

13. The first connector according to claim 11, wherein the first extension arm is bent from the first side edge along the first direction by 15 degrees to 165 degrees, and the second extension arm is bent from the second side edge along the second direction by 15 degrees to 165 degrees.

14. The first connector according to claim 9, wherein the first extension arm and the second extension arm both extend parallel to the connector mating direction; the first contact portion is provided with a lower surface adapted to contact the second connector, and the second contact portion is provided with an upper surface adapted to contact the second connector.

15. A connector assembly comprising:

a first connector; and a second connector adapted to mate with the first connector;

the first connector comprising a plurality of first terminal modules each of which comprises:

a first insulating body; and a first terminal assembly comprising:

a first terminal insert-molded with the first insulating body and comprising:

a first body portion;

a first extension arm connected to one end of the first body portion, the first extension arm being provided with a first contact portion adapted to contact a second connector; and a first tail portion connected to the other end of the first body portion; and a second terminal insert-molded with the first insulating body and comprising:

a second body portion;

a second extension arm connected to one end of the second body portion, the second extension arm being provided with a second contact portion adapted to contact the second connector; and a second tail portion connected to the other end of the second body portion, wherein the first contact portion and the second contact portion are arranged in a staggered manner along a left-to-right direction and a top-to-bottom direction which are both perpendicular to a connector mating direction;

the first insulating body comprising:

a first grounding piece provided with a first shielding portion which is located on one side of the first contact portion and the second contact portion; and a second grounding piece provided with a second shielding portion which is located on the other side of the first contact portion and the second contact portion; wherein the first grounding piece and the second grounding piece are located on opposite sides of the first terminal and the second terminal;

the second connector further comprising a plurality of second terminal modules each of which comprises:

a second insulating body; and a third terminal and a fourth terminal both insert-molded with the second insulating body, the third terminal comprising a third contact portion to mate with the first contact portion, and the fourth terminal comprising a fourth contact portion to mate with the second contact portion.

16. The connector assembly according to claim 15, wherein the first terminal comprises a first base having a first side edge from which the first extension arm is bent along a first direction; and the second terminal comprises a second base portion having a second side edge from which the second extension arm is bent along a second direction, one of the first direction and the second direction is the left-to-right direction, and the first direction is opposite to the second direction; and wherein the first extension arm is bent from the first side edge along the first direction by 15 degrees to 165 degrees, and the second extension arm is bent from the second side edge along the second direction by 15 degrees to 165 degrees.

17. The connector assembly according to claim 15, wherein when the first connector is mated with the second connector, the first contact portion contacts an upper surface of the third contact portion and the second contact portion contacts a lower surface of the fourth contact portion.

18. The connector assembly according to claim 15, further comprising a first head housing and a second head housing mating with the first head housing, the plurality of first terminal modules are arranged side by side and mounted to the first head housing, and the plurality of second terminal modules are arranged side by side and mounted to the second head housing.

19. The connector assembly according to claim 15, wherein the third contact portion of the third terminal is a flat plate shape, and the fourth contact portion of the fourth terminal is a flat plate shape.

20. The connector assembly according to claim 15, wherein the first connector is mounted to a first circuit board, and the second connector is mounted to a second circuit board which is perpendicular to the first circuit board.

* * * * *